US011111711B2

(12) United States Patent
Capur et al.

(10) Patent No.: US 11,111,711 B2
(45) Date of Patent: Sep. 7, 2021

(54) SIMPLY FITTED FURNITURE HINGE

(71) Applicant: SAMET KALIP VE MADEN ESYA SAN. VE TIC A.S., Istanbul (TR)

(72) Inventors: Ertac Capur, Beylikdüzü/Istanbul (TR); Ufuk Kiziltan, Istanbul (TR); Himmet Tanriverdi, Esenyurt/Istanbul (TR)

(73) Assignee: SAMET KALIP VE MADEN ESYA SAN. VE TIC A.S.

( * ) Notice: Subject to any disclaimer, the term of this patent is extended or adjusted under 35 U.S.C. 154(b) by 146 days.

(21) Appl. No.: 16/481,737

(22) PCT Filed: Feb. 13, 2017

(86) PCT No.: PCT/TR2017/000028
§ 371 (c)(1),
(2) Date: Jul. 29, 2019

(87) PCT Pub. No.: WO2018/147818
PCT Pub. Date: Aug. 16, 2018

(65) Prior Publication Data

US 2019/0390492 A1 Dec. 26, 2019

(51) Int. Cl.
*E05D 7/12* (2006.01)
*E05D 5/02* (2006.01)

(52) U.S. Cl.
CPC ..... *E05D 7/12* (2013.01); *E05D 5/0215* (2013.01); *E05D 7/123* (2013.01); *E05D 2007/128* (2013.01); *E05Y 2900/20* (2013.01)

(58) Field of Classification Search
CPC ..... E05D 5/0215; E05D 5/023; E05D 5/0276; E05D 5/046; E05D 5/065; E05D 7/12;
(Continued)

(56) References Cited

U.S. PATENT DOCUMENTS 2,474,311 A * 6/1949 Graham ..... E05D 7/12 220/843
3,285,464 A * 11/1966 Boydman ..... E05D 5/04 220/837

(Continued)

FOREIGN PATENT DOCUMENTS

CN 106193866 A 12/2016
DE 7924808 U1 11/1979

(Continued)

OTHER PUBLICATIONS

Co-Pending U.S. Appl. No. 16/481,740, filed Feb. 13, 2017 (not prior art).

(Continued)

*Primary Examiner* — Jeffrey O'Brien
(74) *Attorney, Agent, or Firm* — Lucian Wayne Beavers; Patterson Intellectual Property Law, PC

(57) ABSTRACT

The invention relates to a furniture hinge having a mounting body and a hinge body with a hinge arm for fastening, in a hinged manner, a furniture door or the like to a furniture carcass. According to the invention, at least one section of the hinge arm or of a component connected to the hinge arm has at least one guide section which interacts with a sliding guide on the mounting body in such a manner that the hinge arm or the component connected to the hinge arm is mounted displaceably in the sliding guide along an installation direction and is retained transversely to the installation direction and that a movement of the hinge arm against the installation direction can be blocked when an installation position is reached. The invention further relates to an associated method for mounting a furniture door in a hinged manner. The furniture hinge and the method permit the installation of a furniture door, flap or the like to a furniture carcass in a fast and reliable fashion.

20 Claims, 9 Drawing Sheets

Figure 1:
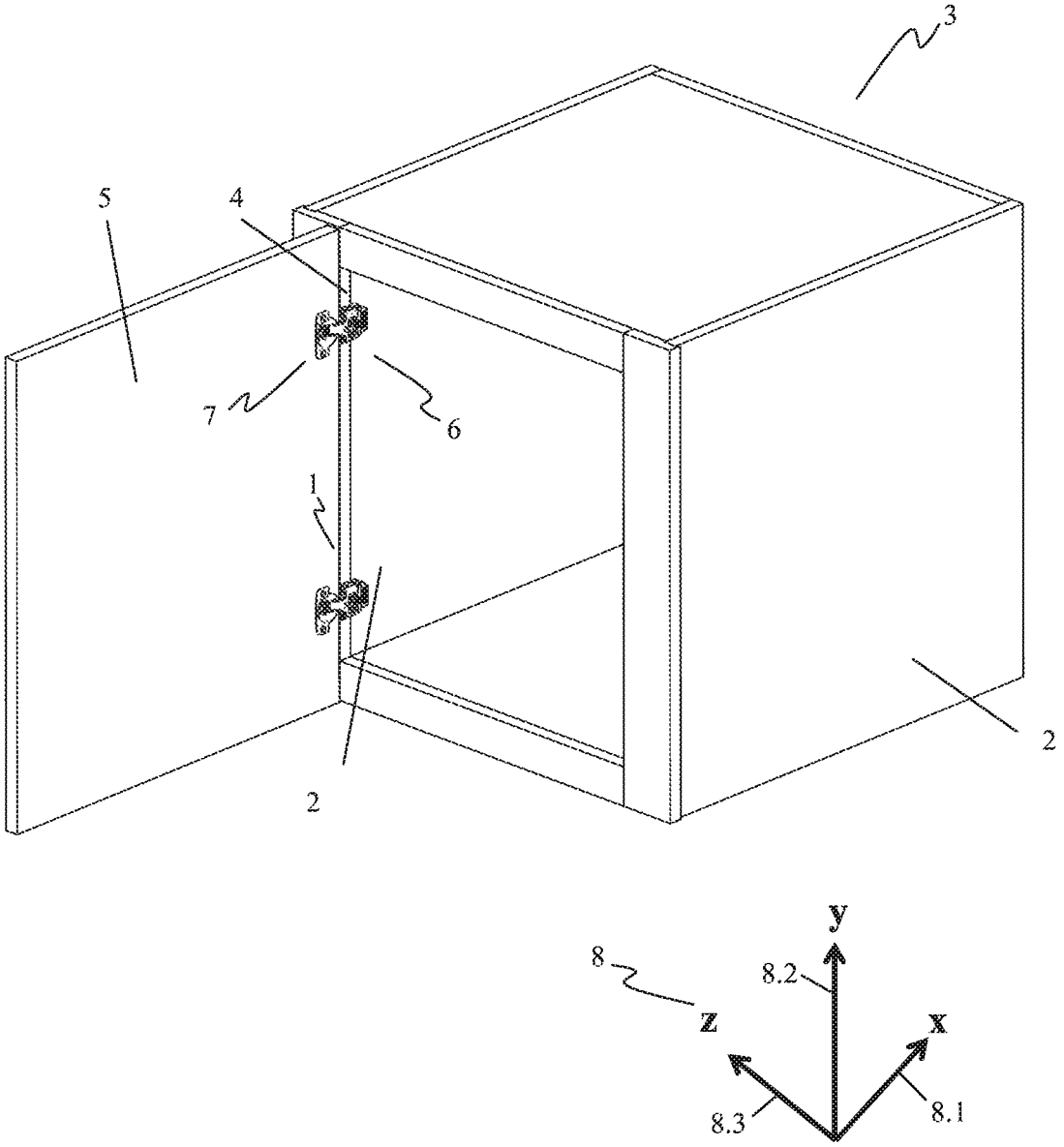

(58) Field of Classification Search
CPC ..... E05D 7/123; E05D 2007/128; E05Y 2600/53
See application file for complete search history.

(56) References Cited

U.S. PATENT DOCUMENTS 3,423,786 A * 1/1969 Arias, Jr. ..... E05D 7/12 16/257
3,728,758 A * 4/1973 Johansen ..... E05D 7/12 16/257
3,965,532 A * 6/1976 Wigfall ..... E05D 7/12 16/270
4,157,600 A * 6/1979 Thomas ..... E05D 7/10 16/376
4,312,098 A * 1/1982 Sundermeier ..... E05D 5/0276 16/240
5,193,308 A * 3/1993 Davidian ..... E05D 5/023 16/257
5,381,920 A * 1/1995 Lin ..... B25H 3/02 16/261
5,392,493 A * 2/1995 Youngdale ..... E05D 7/04 16/237
5,577,296 A * 11/1996 Grass ..... E05D 7/123 16/258
5,826,305 A * 10/1998 Domenig ..... E05D 7/04 16/235
5,920,958 A * 7/1999 Domenig ..... E05D 7/0423 16/237
6,715,181 B1 * 4/2004 Fries ..... E05D 7/0415 16/271
6,810,563 B1 * 11/2004 Domenig ..... E05D 5/065 16/236
6,883,204 B2 * 4/2005 Salice ..... E05D 5/065 16/236
6,996,877 B2 * 2/2006 Booker ..... E05D 7/0407 16/236
7,350,272 B2 * 4/2008 Fries ..... E05D 7/02 16/246
7,383,615 B2 * 6/2008 Pozzi ..... E05D 5/08 16/258
7,509,708 B1 * 3/2009 Radke ..... E05D 7/0415 16/237
7,516,517 B2 * 4/2009 Fries ..... E05D 7/02 16/246
7,571,516 B2 * 8/2009 Lueffe ..... E05D 7/0423 16/235
8,079,114 B2 * 12/2011 Fries ..... E05D 7/02 16/243
8,262,142 B2 * 9/2012 Ramsauer ..... E05D 5/023 292/163
8,307,498 B2 * 11/2012 Krammer ..... E05F 5/006 16/83
8,943,653 B2 * 2/2015 Ramsauer ..... E05D 5/023 16/383
9,295,347 B2 * 3/2016 Mackay ..... A47G 1/21
9,316,035 B2 * 4/2016 Ng ..... E05D 7/0407
9,376,847 B2 * 6/2016 Salice ..... E05D 5/0276
9,416,573 B2 * 8/2016 Sabrowski ..... E05D 7/0415
9,874,049 B1 * 1/2018 McGregor ..... E05D 7/0415
10,415,283 B2 * 9/2019 Lowe ..... E05D 5/08
2005/0251961 A1 * 11/2005 Liu ..... E05D 7/0415 16/242
2006/0283869 A1 * 12/2006 Soncini ..... A45C 13/005 220/836
2012/0167342 A1 * 7/2012 Wu ..... E05D 7/0415 16/239
2015/0068126 A1 * 3/2015 Forster ..... E05F 5/006 49/381
2015/0315832 A1 * 11/2015 Wu ..... E05D 3/02 16/54
2016/0032636 A1 * 2/2016 Dai ..... E05D 7/0415 16/65

FOREIGN PATENT DOCUMENTS

EP 1367203 A2 12/2003
EP 1688572 A2 8/2006
EP 2766547 A1 8/2014
WO 9845560 A1 10/1998
WO 2009124332 A1 10/2009
WO 2013149632 A1 10/2013

OTHER PUBLICATIONS

International Search Report for corresponding PCT/TR2017/000028 dated Oct. 18, 2017, 11 pages (not prior art).

* cited by examiner

SIMPLY FITTED FURNITURE HINGE

The invention relates to a furniture hinge for the jointed fastening of a furniture door, shutter or the like to a furniture carcass, in particular to a frame of the furniture carcass, having a fitting body for fastening the furniture hinge to the furniture carcass and a hinge body for fastening the furniture hinge to the furniture door, shutter or the like, wherein a pivotably mounted hinge arm is associated with the hinge body and wherein the hinge arm can be fastened indirectly or directly to the fitting body.

The invention furthermore relates to a method for the jointed fastening of a furniture door, shutter or the like by at least one furniture hinge to a furniture carcass, in particular to a frame of a furniture carcass, wherein a fitting body of the furniture hinge is fastened to the furniture carcass and a hinge body of the furniture hinge is fastened to the furniture door, shutter or the like, wherein a pivotably mounted hinge arm is associated with the hinge body and wherein the hinge arm is fastened indirectly or directly to the fitting body.

Document EP 1 367 203 A2 discloses a furniture hinge having a hinge cup and a base plate coupled in a jointed manner via a multi-part arm connection. To this end, a hinge arm is connected in a jointed manner to the base plate. Opposite this, an angled holding arm is fastened to the hinge arm via a first eccentric. A second eccentric connects the holding arm opposite the first eccentric to an arm portion which is fastened to the base plate via a third eccentric. The base plate can be fastened by fastening screws to a furniture wall, in particular to the end face of a vertically extending frame of the furniture piece (face frame). The hinge cup is fixed to a furniture door. The eccentrics each enable a linear adjustment so that the furniture door can be adjusted in three spatial directions in relation to the furniture wall. They connect the portions of the arm connection and the base plate permanently so that the furniture hinge can only be fitted as a cohesive component. To fasten the furniture door to the furniture carcass, a fitter must therefore hold the door whilst simultaneously screwing the base plate to the furniture wall. This involves time and effort and can lead to imprecise fitting of the door or damage to the furniture piece in the event that the fitter drops the door in unfavorable installation situations. Fitting is difficult, in particular in the case of furniture pieces in which the furniture hinge has to be fastened to the end face of a frame (face frame), since only a small bearing surface for the base plate is available here.

DE 7 924 808 U1 discloses a cabinet having a door which is mounted to be pivotable about a vertical axis. A fitting block of a hinge is screwed to a vertically extending strip of the cabinet. Opposite this, a hinge cup is embedded in a corresponding bore in a furniture door of the cabinet and connected thereto. A hinge arm connected to the hinge cup in a jointed manner is guided to the fitting block and fastened thereto by a screw. To fit the door, the hinge cup is therefore firstly attached to the door and the fitting block is attached to the strip of the cabinet. The door is then aligned in relation to the carcass of the cabinet so that the hinge arm abuts against the fitting block and can be screwed thereto. The door must also be held by a fitter here and a tool must be simultaneously actuated for screwing in the connecting screw between the hinge arm and the fitting block. This involves effort and, in particular in unfavorable fitting situations, can lead to the fitter tilting or dropping the door, which can lead to damage to the door or the furniture piece.

It is therefore an object of the invention to provide a furniture hinge which enables simple fitting of a furniture door, shutter or the like to a furniture carcass of a furniture piece, in particular to a frame (face frame) of the furniture carcass.

It is furthermore an object of the invention to provide a method which enables simple fitting of a furniture door, shutter or the like to a furniture carcass of a furniture piece, in particular to a frame (face frame) of the furniture carcass.

The object of the invention is achieved in that at least one portion of the hinge arm or a component connected to the hinge arm has at least one guide portion, which cooperates with a sliding guide of the fitting body in such a way that the hinge arm or the component connected to the hinge arm is mounted in the sliding guide to be displaceable along a fitting direction and is held transversely to the fitting direction and in that a movement of the hinge arm contrary to the fitting direction can be blocked when a fitting position is reached. As a result of the two-part design of the furniture hinge, a hinge part (fitting body) can be pre-fitted on the furniture carcass, in a particular on a frame of the furniture carcass, and a hinge part (hinge body) can be pre-fitted on the furniture door, the shutter or the like. The furniture door, shutter or the like can then be held on the furniture carcass by a fitter and the guide portion of the hinge arm or the component connected thereto can be inserted into the sliding guide of the fitting body. The fitting direction is also proportionally aligned preferably transversely or in the direction of the acting gravitational force, not contrary to the acting gravitational force. Since the hinge arm or the component connected to the hinge arm is held transversely to the fitting direction in the sliding guide, the furniture door, shutter or the like is provisionally held on the furniture carcass when the guide portion is inserted into the sliding guide. It therefore no longer has to be held by the fitter. If the guide portion is inserted into the guide as far as its final fitting position, it can be indirectly or directly blocked against sliding out of the guide. The hinge arm and the fitting body and therefore the furniture door, shutter or the like and the furniture carcass are therefore fixedly and pivotably connected to one another. When the fitting position is reached, the fitter does not have to hold the weight of the furniture door, shutter or the like. He therefore has his hands free to block the movement of the hinge arm contrary to the fitting direction by means of a suitable blocking element. The fitting of the furniture door, shutter or the like can therefore be carried out simply and reliably in that the guide portion is firstly inserted into the sliding guide and the hinge arm or the component connected to the hinge arm is subsequently blocked against sliding out of the sliding guide. A furniture door, shutter or the like is preferably held by at least two furniture hinges according to the invention. The at least two guide portions can then be inserted into the at least two sliding guides and the furniture door, shutter or the like can thus be held provisionally. In a second operating step, the movement of the hinge arms contrary to the fitting direction can then be blocked when their fitting position is reached.

According to a preferred design variant, it can be provided that the movement of the hinge arm contrary to the fitting direction can be blocked via a blocking element which can be closed without tools. The guide portion can therefore firstly be inserted into the sliding guide and then blocked by means of the blocking element which can be closed without tools. The fitting of the furniture door, shutter or the like can thus be simplified considerably. For example, screw connections connecting the hinge parts do not have to be screwed in with a screwdriver, which can also considerably reduce the fitting time.

It can preferably be provided that the blocking element can be opened without tools and the hinge arm can be released from the fitting body. Dismantling of the furniture door, shutter or the like is therefore simplified considerably. After opening the blocking element, the guide portion associated with the hinge arm is furthermore guided in the sliding guide of the fitting body so that the furniture door, shutter or the like is held on the furniture carcass. A fitter therefore has both hands free to grip the furniture door, shutter or the like and to draw the guide portion out of the sliding guide. The risk of the furniture door falling off and being damaged during the dismantling procedure is therefore considerably reduced.

According to a preferred design variant of the invention, it can be provided that the blocking element is movably mounted and fixes the hinge arm or the component connected to the hinge arm on the fitting body in a closed position and releases it in an open position. For fitting the furniture door, shutter or the like, the guide portion associated with the hinge arm must be introduced into the sliding guide and the blocking element must be adjusted into its open position so that the hinge arm can be adjusted until it is in its fitting position. Once this is achieved, the blocking element is adjusted into its closed position and the linear movement of the hinge arm is therefore blocked. The two positions of the blocking element are clearly defined so that faulty fitting can be ruled out to the greatest extent possible.

The fitting of the furniture door, shutter or the like can be further simplified in that the blocking element is held in the closed position by at least one spring and in that the blocking element can be adjusted into the open position contrary to the spring force introduced by the spring. The blocking element is therefore adjusted into its closed position without the effect of an external force. In this closed position, the fitted hinge arm is indirectly or directly fixed on the fitting body. It is therefore ensured via the spring that the hinge arm is reliably held on the fitting body without the effect of an external force and is not inadvertently released. For fitting and dismantling the furniture door, shutter or the like, the blocking element can be simply and quickly adjusted into its open position and the connection between the hinge arm and the fitting body can be released.

Depending on the installation situation of the furniture hinge, good accessibility of the blocking element can be achieved in that the blocking element is arranged on the hinge arm or on the component connected to the hinge arm or on the fitting body.

The fitting of the furniture door, shutter or the like can be simplified in that the blocking element can be adjusted from its closed position into its open position by the hinge arm or the component connected to the hinge arm as a result of the insertion movement of the hinge arm along the fitting direction and in that the blocking element is adjusted into its closed position by the at least one spring in the fitting position of the hinge arm or the component connected to the spring arm. A fitter therefore only has to align the furniture door in relation to the furniture carcass and insert the guide portion into the sliding guide. At the end of the insertion movement, the hinge arm or the component connected to the hinge arm strikes the blocking element. Through the exertion of a slight force, aligned in the fitting direction, on the hinge arm or the component connected to the hinge arm, the blocking element is adjusted from its closed position into its open position contrary to the acting spring force and therefore clears the path so that the hinge arm can be displaced into its fitting position. Once this is achieved, the blocking element is adjusted back into its closed position as a result of the acting spring force and the movement of the hinge arm contrary to the fitting direction is blocked. The hinge parts can therefore be connected to one another in a continuous fitting movement, in which the guide portion is inserted into the sliding guide. To this end, the fitter advantageously does not have to operate the blocking element separately by hand. He therefore has both hands free to guide the furniture door, shutter or the like in such a way that the guide element is fed into the sliding guide and is blocked when the fitting position is reached. This is particularly advantageous when fitting a furniture door, shutter or the like using two or more furniture hinges. In this case, the hinge arms are all adjusted into in the same position, preferably into their open position, and the guide elements are then inserted into the associated sliding guides until, at the end of the insertion movement, the respective blocking elements block the hinge arms or the components connected thereto against sliding out of the sliding guide.

A simple design of the sliding guide can be achieved in that the fitting body has a base support having a fitting portion which has lateral guides which are arranged laterally to the fitting direction and each form a sliding guide, in particular guide groove, facing the fitting portion and in that the hinge arm, or the component connected thereto, has opposing guide portions which can be mounted to be linearly movable in the opposing sliding guides, in particular guide grooves, of the fitting body. The guide portions can be inserted simply and effortlessly into the sliding guide formed by guide grooves. As a result of the spaced arrangement of the guide grooves, torques, such as those transmitted, for example, to the sliding guide via the weight of the furniture door, shutter or the like, can be reliably absorbed. The guide grooves merely enable a sliding movement of the guide portion in or contrary to the fitting direction. The hinge arm or the component connected thereto is therefore reliably held transversely to the fitting direction. The lateral guides and the guide portions are formed in such a way that sufficiently high forces for permanently supporting the furniture door, shutter or the like can be transmitted from the guide portions to the lateral guides and therefore the fitting body and the frame of the furniture piece.

Simple and reliable blocking of the hinge arm in its fitting position can be achieved in that the hinge arm or the component connected thereto has a holding region facing in the fitting direction and having a latching recess, in that the blocking element has a holding portion and in that, in the fitting position of the hinge arm, the blocking element engages with its holding portion in the latching recess.

In this case, it can preferably be provided that the blocking element has a run-in chamfer which, during the insertion of the hinge arm or the component connected to the hinge arm into the sliding guide of the fitting body, is guided into the adjustment path of the holding region of the hinge arm or the component connected thereto, and/or in that the holding region of the hinge arm or the component connected thereto has a chamfered portion and in that the blocking element has a run-in chamfer which, during the insertion of the hinge arm or the component connected to the hinge arm into the sliding guide of the fitting body, is guided into the adjustment path of the chamfered portion. In this case, the run-in chamfer can preferably be arranged on the holding portion of the blocking element. The blocking element is particularly preferably pressed into its closed position by a spring force. Towards the end of the insertion movement of the guide portion into the sliding guide, the holding portion is pressed against the run-in chamfer of the blocking element. In this case, the holding portion slides along the run-in chamfer and presses this to the side. The pivotably mounted blocking element is thus adjusted into its open position, preferably contrary to a spring force. In this open position, the hinge arm or the component connected to the hinge arm can be pushed into its fitting position. The pressure on the run-in chamfer is thus removed and the operating element pivots back into its closed position again. The hinge arm is therefore fixed in relation to the fitting body. If the holding region of the hinge arm or the component connected thereto has a chamfered portion, this strikes against the run-in chamfer of the blocking element during the insertion of the guide portion into the sliding guide. The chamfered portion and the run-in chamfer preferably have the same alignment so that the chamfered portion slides over the run-in chamfer during the further insertion and thus adjusts the blocking element from its closed position into its open position. During the further insertion, the hinge arm then arrives in its fitting position. The holding portion of the blocking element then preferably arrives in the region of the latching recess of the holding region of the hinge arm or the component connected to the hinge arm and engages therein as a result of an acting spring force so that the hinge arm or the component connected to the hinge arm is held in the fitting position.

It is provided that the blocking element has an actuating portion with which the blocking element can be adjusted manually from its closed position into its open position contrary to the acting spring force; the blocking element can therefore be operated manually. The actuating portion is preferably arranged in such a way that it is easily accessible during the fitting or dismantling of the furniture door, shutter or the like. During the fitting of the furniture door, shutter or the like, the guide portion of the hinge arm or the component connected to the hinge arm is firstly inserted into the sliding guide of the fitting body until it abuts against the blocking element. The furniture door, shutter or the like is now held automatically. In the further fitting procedure, an increased force can now be applied to the guide portion in the fitting direction in order to adjust the blocking element into its open position, or the blocking element can be adjusted manually into its open position by means of the actuating portion and the guide portion can be displaced into its fitting position. For dismantling the furniture door, shutter or the like, the blocking element is adjusted manually into its open position by means of the actuating portion and the guide portion is drawn out of its fitting position. This can take place in succession for a plurality of furniture hinges provided on the furniture door, shutter or the like, wherein, on the already open furniture hinges, the guide portions remain partially inserted in the associated sliding guides and are thus held. It is therefore effectively prevented that the furniture door, shutter or the like falls to the floor during the dismantling thereof.

It can preferably be provided that the blocking element has at least one stop with which a movement of the blocking element in the direction of the acting spring force beyond the closed position is blocked. The blocking element therefore remains precisely aligned in relation to the holding region of the hinge arm or the component connected to the hinge arm during the insertion into the sliding guide.

Precise positioning of the hinge arm or the component connected to the hinge arm in its fitting position in relation to the fitting body can be achieved in that at least one stop portion is arranged on the hinge arm or the component connected to the hinge arm, which stop portion blocks the insertion movement of the hinge arm or the component connected to the hinge arm into the sliding guide of the fitting body in the fitting direction when the fitting position is reached. It can thus be ensured that, for example, a holding portion of the blocking element is aligned precisely in relation to a latching recess of the hinge arm or the component connected to the hinge arm so that the holding portion can engage in the latching recess and therefore block the hinge arm or the component connected thereto.

Reliable mounting of the furniture door, shutter or the like when the guide portion is partially inserted into the linear guide can be achieved in that the holding region or the chamfered portion of the hinge arm or the component connected to the hinge arm impacts against the run-in chamfer of the blocking element in the last movement portion of the insertion movement of the hinge arm along the fitting direction, in particular within the last 5% of the insertion movement of the hinge arm. The guide portion can therefore firstly be inserted into the linear guide until the impact occurs. It is thus held transversely to the fitting direction and firstly fixes the furniture door, shutter or the like provisionally. The fitting position, in which the blocking element blocks the hinge arm or the component connected to the hinge arm, is then achieved by a linear displacement of the guide portion along the last movement portion of the insertion movement.

To enable the furniture door, shutter or the like to be aligned in relation to the furniture carcass, at least in one spatial direction, it can be provided that the hinge arm is connected to an intermediate piece, that the intermediate piece is connected to a connecting element, which can be fixed to the fitting body, and that the position of the hinge arm in relation to the intermediate piece can be adjusted at least in one spatial direction and/or that the position of the intermediate piece in relation to the connecting element can be adjusted at least in one spatial direction.

The easy and positionally precise fitting of the furniture hinge on a frame of the furniture carcass (face frame) can be enabled in particular in that the fitting body has a fitting surface for lying against the furniture carcass, in particular against the frame of the furniture carcass, and in that at least one stop protrudes over the fitting surface. For fitting purposes, the fitting surface can be placed against the frame. In this case the stop can be pressed against the edge of the frame. The fitting body is therefore aligned in relation to the frame. The bores through which the fitting body is screwed to the frame are therefore arranged precisely with respect to the frame, for example centrally on the frame. It can thus be prevented that the fitting screws are screwed in too tightly against the edge of the frame and shear off under a load. Furthermore, fitting bodies of a plurality of provided furniture hinges can be aligned precisely with respect to one another so that the furniture door, shutter or the like can be fitted without twisting.

According to an advantageous design of the invention, it can be provided that the hinge cup has a centering region and a fitting region having a reduced cup depth in relation to the centering region, that a housing with a damper is fastened externally to a base of the hinge cup in the fitting region and that a piston or a cylinder is guided through an opening into the centering region and there into the pivotal region of a joint lever of the hinge arm, which is pivotably mounted in the centering region. The housing with the damper is therefore not arranged in the interior of the hinge cup. When the furniture hinge is fitted, the interior of the hinge cup is thus free, easily accessible and easy to clean. The surface of the hinge cup which is visible when the furniture hinge is installed can be manufactured uniformly, for example from metal. A consistent and high-quality impression of the furniture hinge is thus achieved, along with a simultaneously high mechanical durability of the surface. The damper itself is arranged with its housing behind the hinge cup, protected from external mechanical loads and from contamination. The damper and the housing can therefore be produced economically, for example from plastic which is softer than metal. By arranging the housing with the damper on the fitting region having the reduced cup depth in relation to the centering region, the external dimensions of the assembly remain the same when compared to hinge cups of known furniture hinges, so that the hinge cup can be embedded and fastened in standardized bores in the furniture piece. For fitting the furniture piece, the furniture hinge is preferably present as a pre-fitted structural unit, in which the housing with the damper is already fastened to the fitting region. The furniture hinge can therefore be fastened easily and quickly to the furniture piece. In this case, the centering region enables precise positioning of the hinge cup in the standardized bore and therefore on the furniture piece. As a result of a piston or a cylinder of the damper being guided into the centering region and therefore into the adjustment path of the joint lever, the movement of the furniture door can be damped during the closing procedure.

The object of the invention which relates to the method is achieved in that, in a first method step, at least one portion of the hinge arm or a component connected to the hinge arm is partially inserted into a sliding guide of the fitting body along a fitting direction until the hinge arm or the component connected to the hinge arm strikes a blocking element, wherein, in the partially inserted position, the hinge arm or the component connected to the hinge arm is held transversely to the fitting direction by the sliding guide, in that, in a second method step, during the further insertion of the portion of the hinge arm or the component connected to the hinge arm, a closing force of the blocking element is overcome and the blocking element is adjusted into an open position and in that, when a fitting position of the hinge arm or the component connected to the hinge arm is reached, the blocking element is adjusted into its closed position by an acting spring force and a movement of the hinge arm or the component connected to the hinge arm contrary to the fitting direction is blocked. After the first method step, the hinge arm or the component connected to the hinge arm is held transversely to the fitting direction. The fitting direction is preferably not aligned contrary to the acting gravitational force. The furniture door, shutter or the like is therefore provisionally fixed on the furniture carcass after the first method step. During the further insertion of the portion of the hinge arm or the component connected to the hinge arm, this is displaced into the active region of the blocking element and thus blocked. The hinge arm or the component connected thereto is now secured against being withdrawn from the sliding guide. A fitter can therefore firstly connect one or more furniture hinge parts to one another in such a way that the furniture door, shutter or the like is fastened to the furniture carcass such that it is secured against falling off. In this case, this first connecting step takes place by simply inserting a portion of the hinge arm or the component connected to the hinge arm into a sliding guide, which can also be carried out simply for a plurality of furniture hinges arranged on the furniture door, shutter or the like. The fitter now has both hands free to displace the hinge arm or the component connected to the hinge arm into its fitting position in a second step and to therefore secure the hinge arm or the component connected thereto against sliding out of the sliding guide. In this case, the fitting direction for both connecting steps is the same, so that the fitting of the furniture door, shutter or the like can take place in a continuous movement sequence.

The invention is explained in more detail below with reference to an exemplary embodiment illustrated in the drawings.

Figure 2:
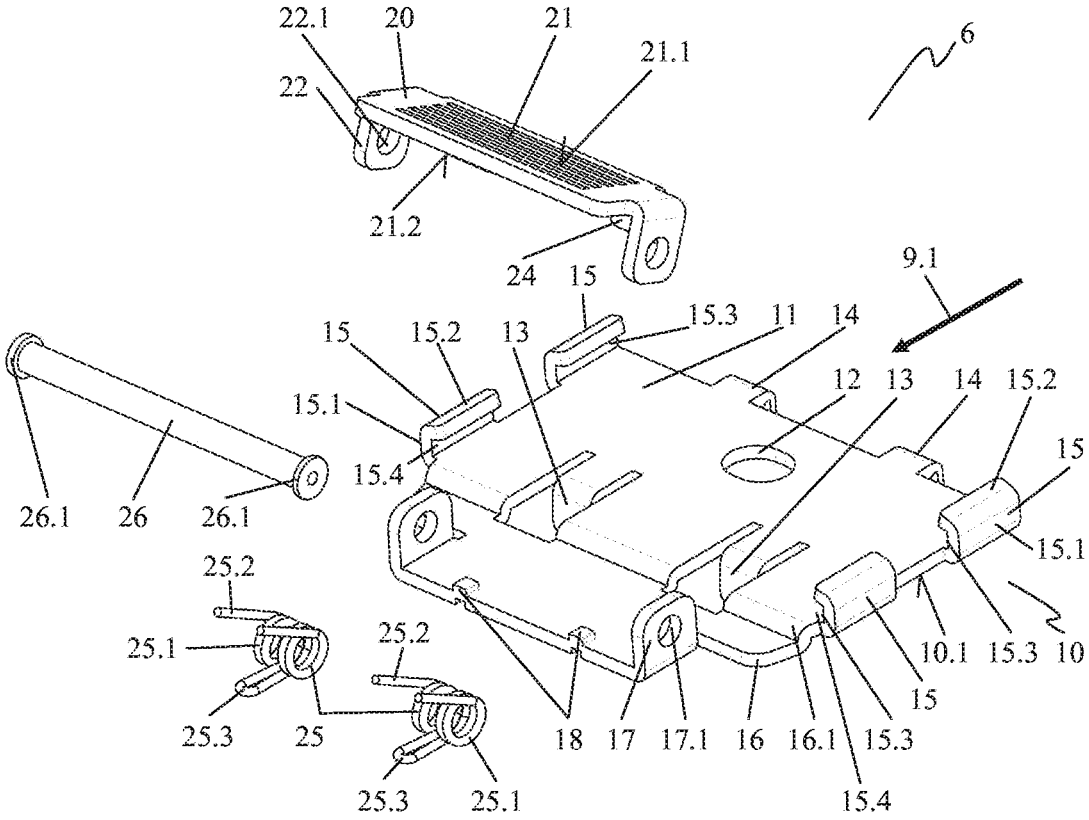
Figure 3:
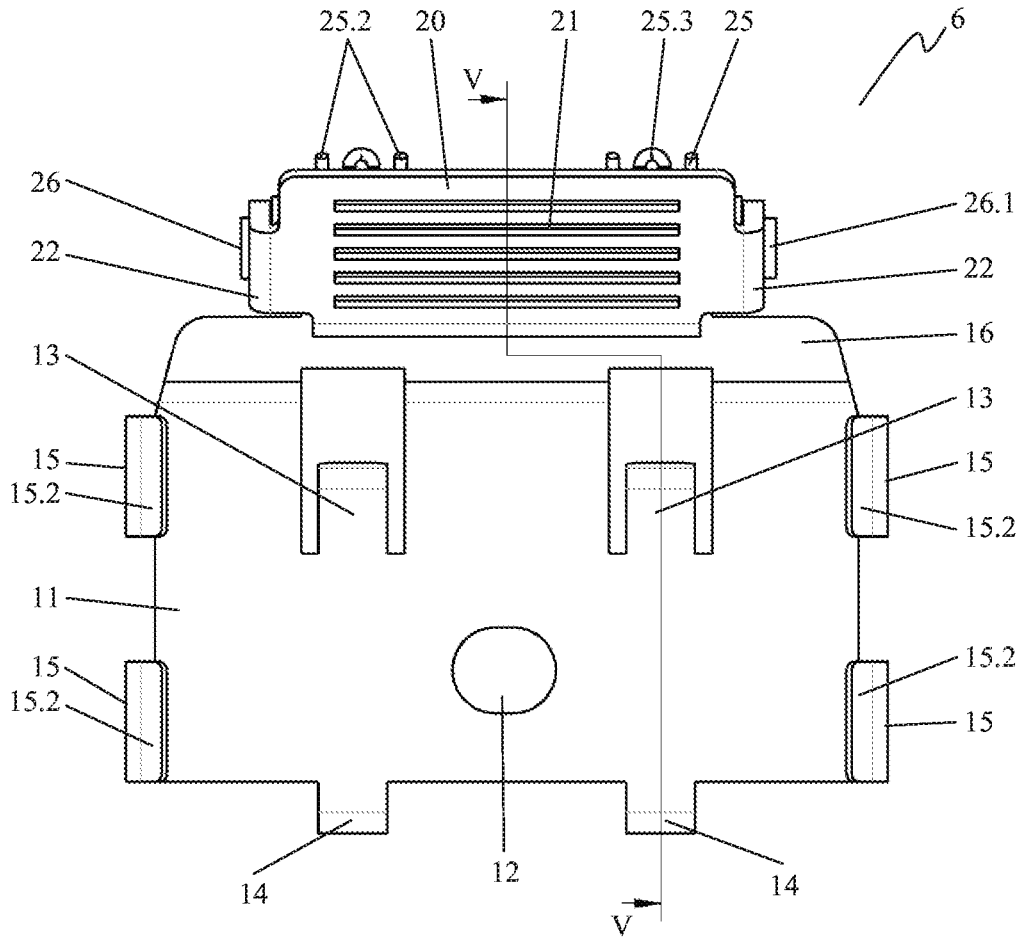
Figure 4:
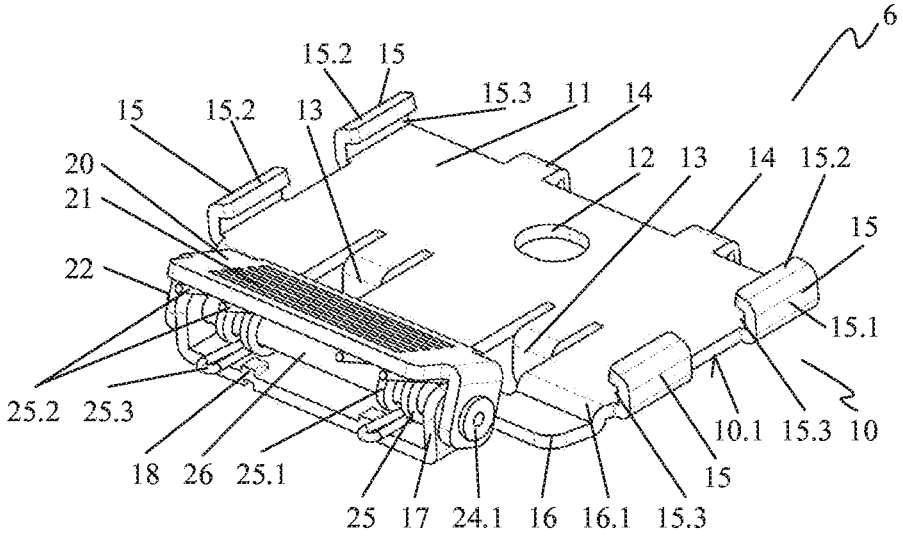
Figure 5:
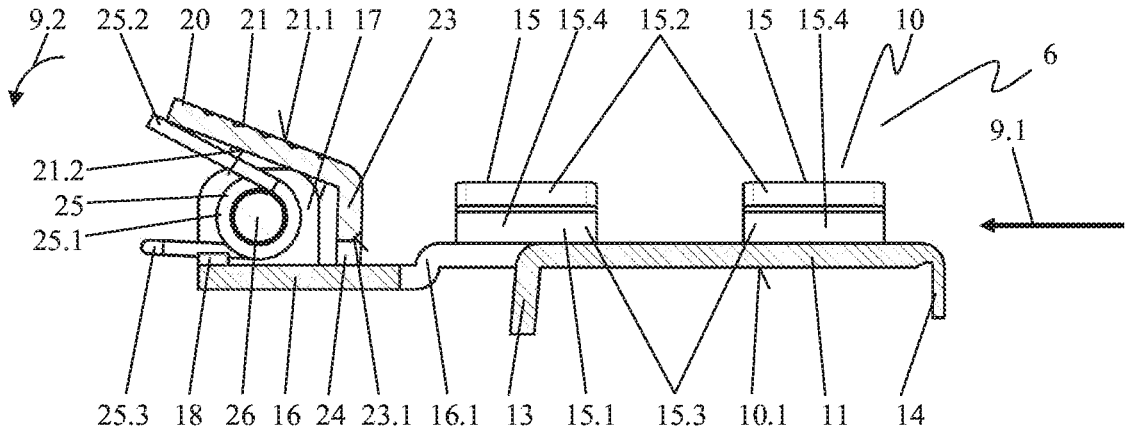
Figure 6:
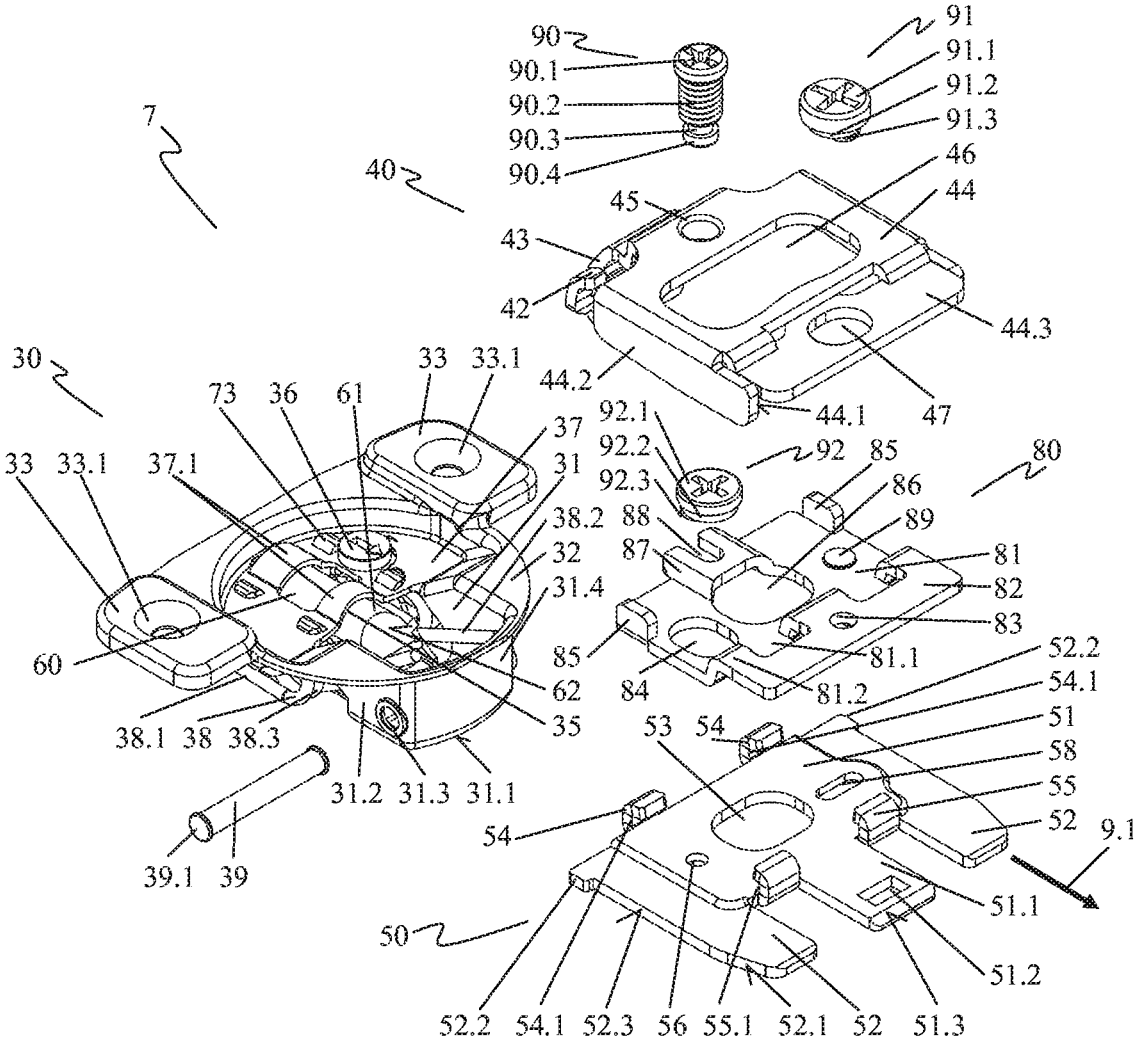
Figure 7:
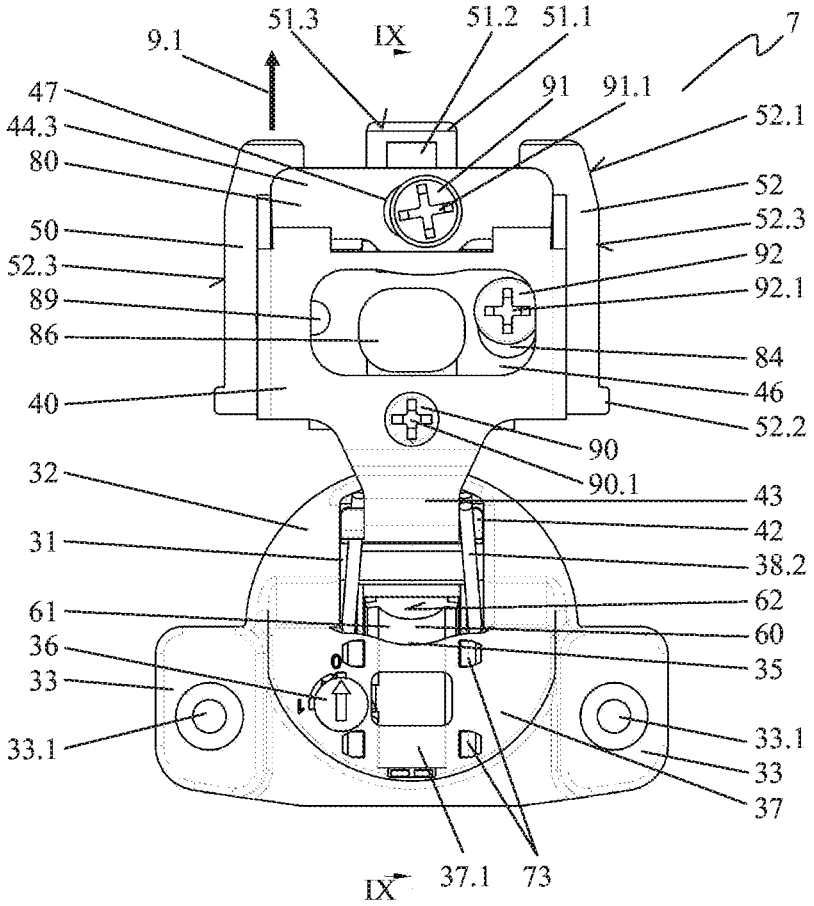
Figure 8:
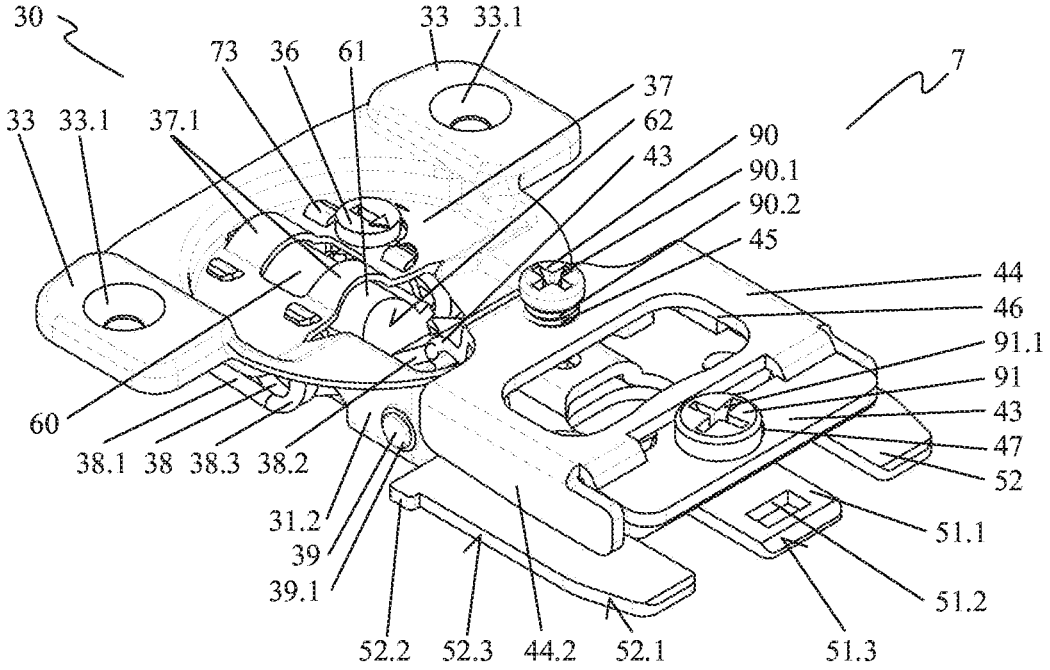
Figure 9:
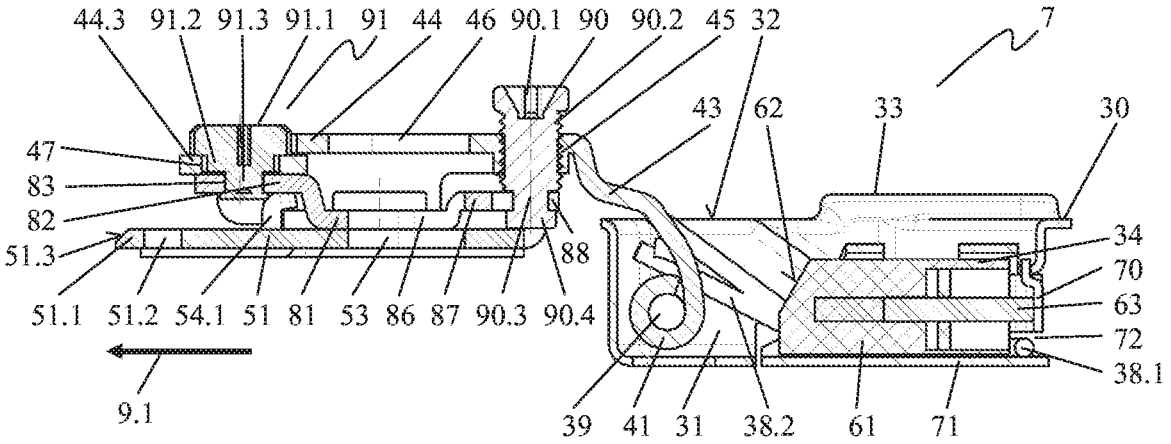
Figure 10:
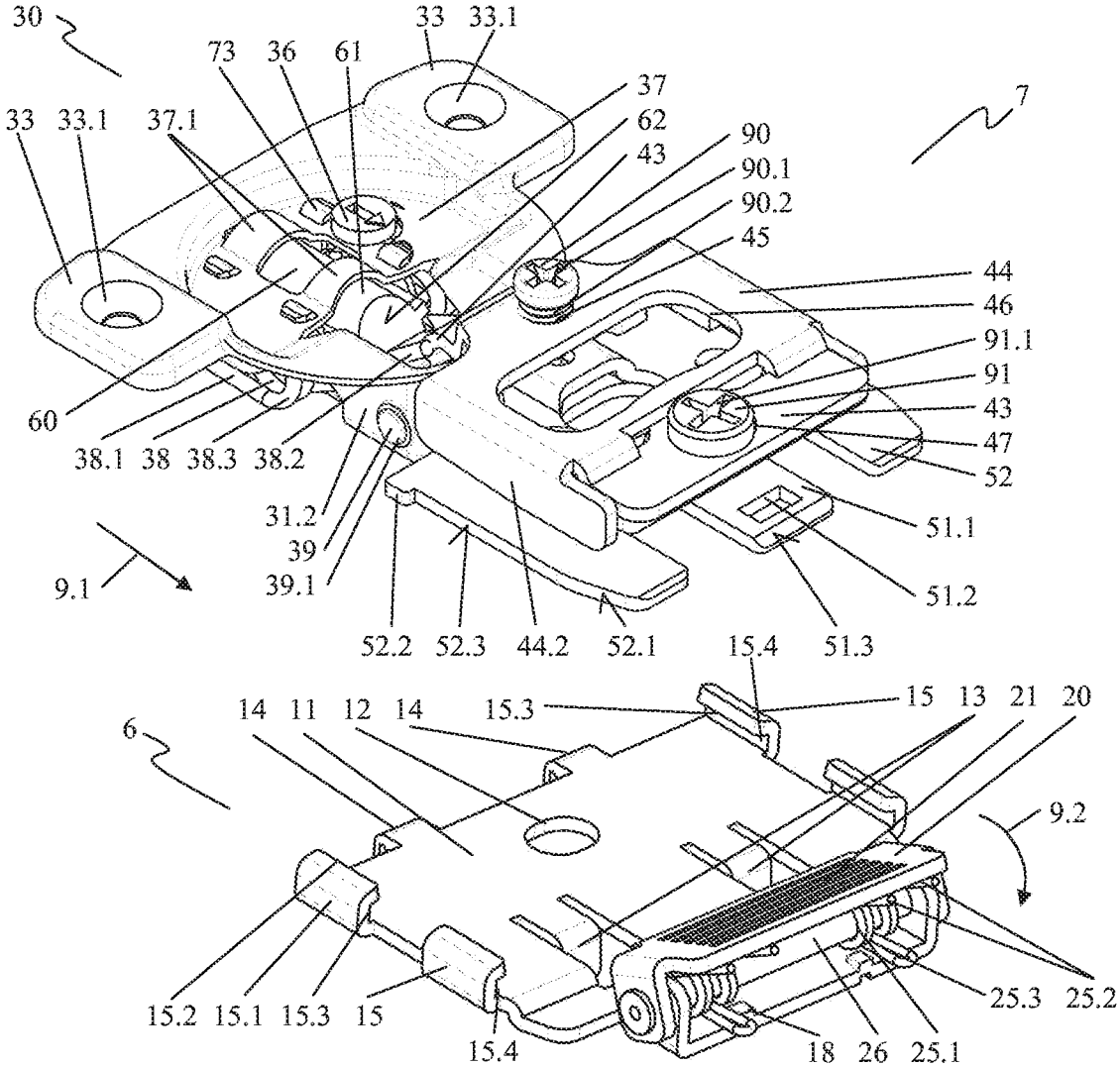
Figure 11:
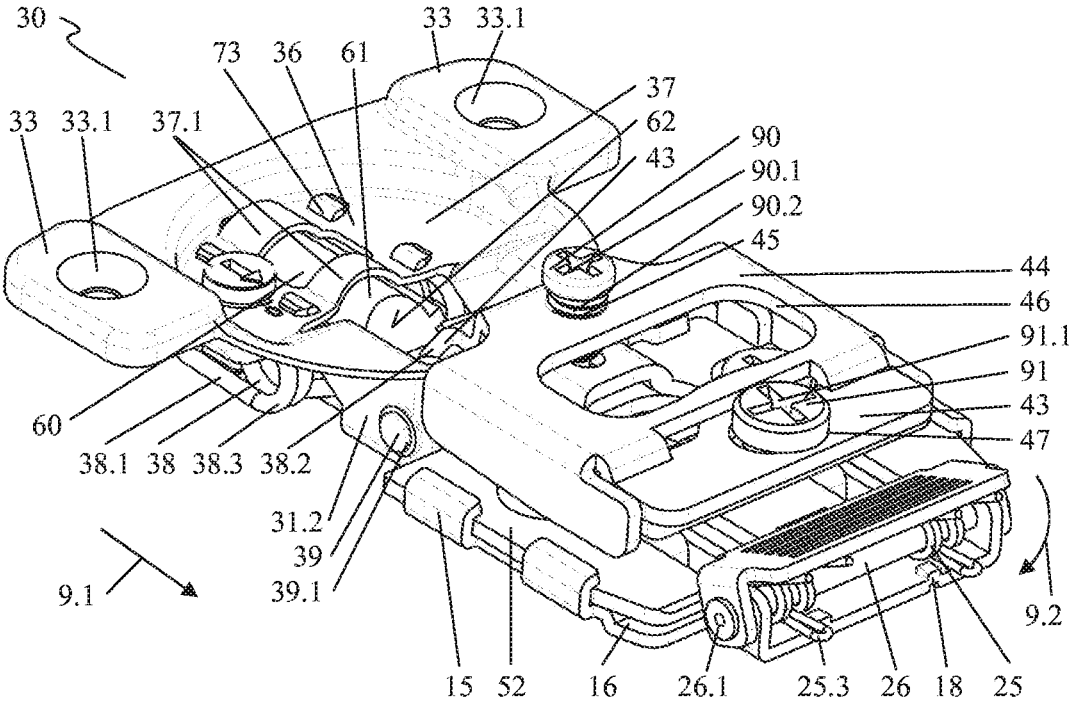
Figure 12:
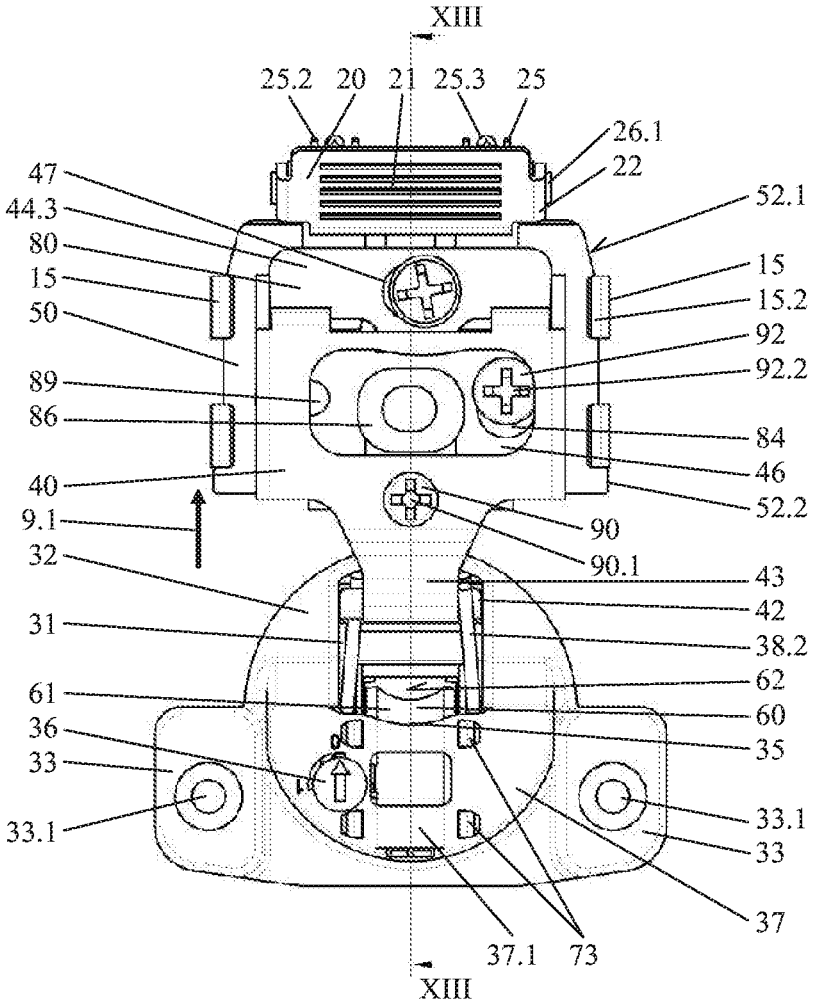
Figure 13:
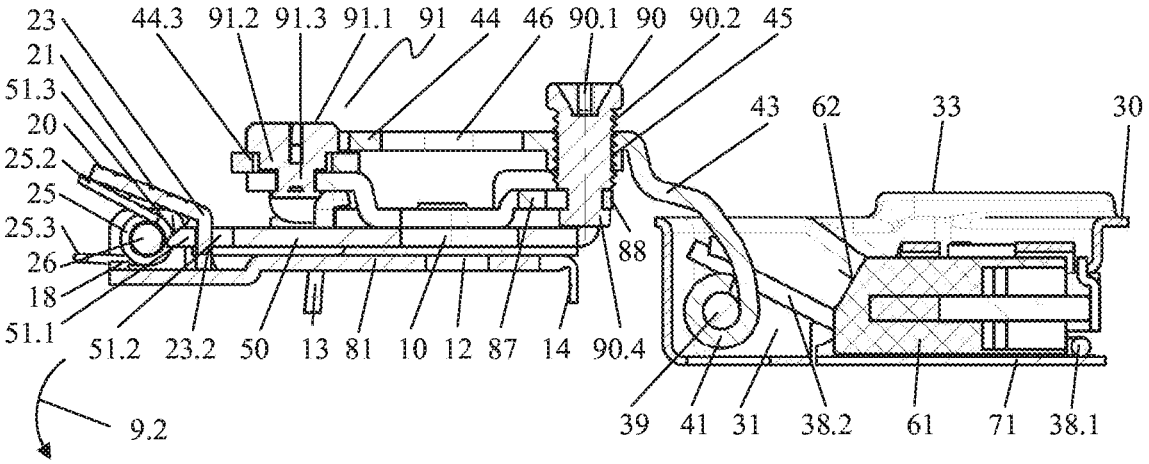
Figure 14:
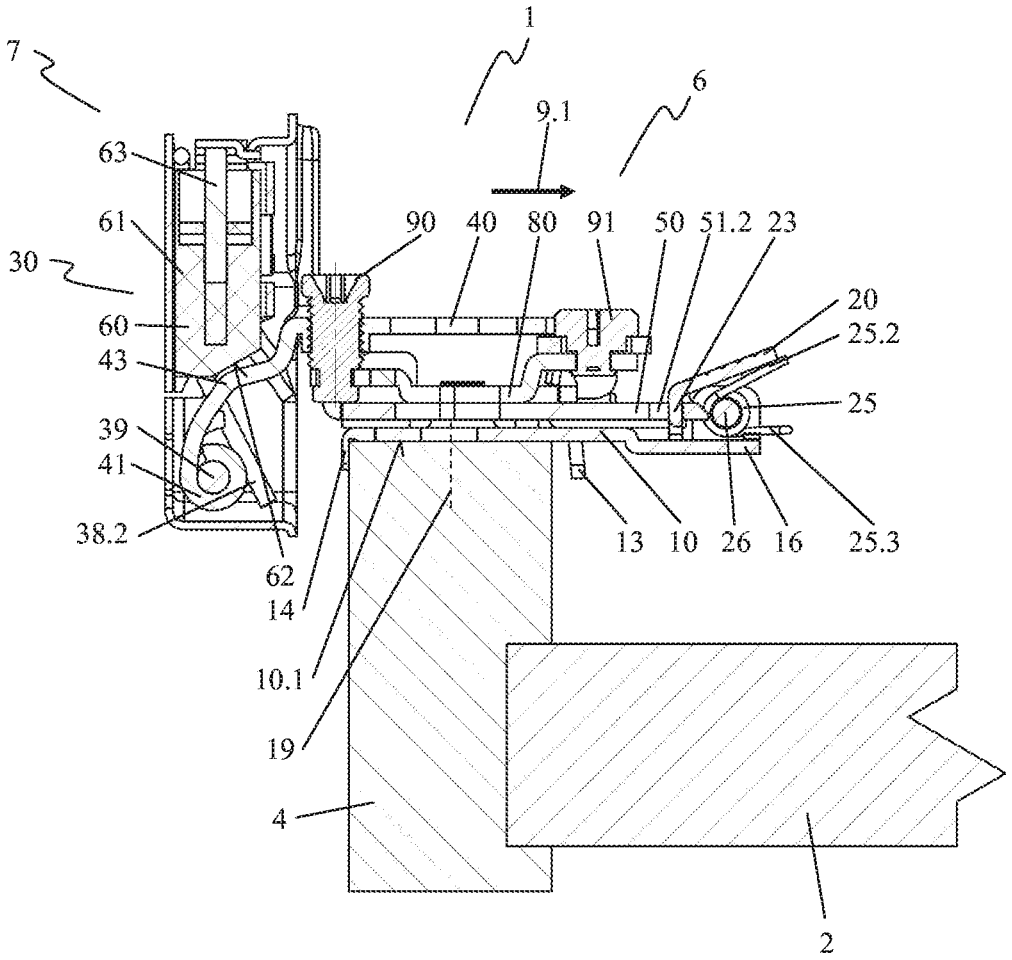

The drawings show:

FIG. 1 in a perspective view, a furniture piece with a furniture door coupled in a jointed manner;

FIG. 2 in an exploded illustration, a fitting body for fastening the furniture hinge to a furniture carcass;

FIG. 3 the assembled fitting body shown in FIG. 2, in a plan view,

FIG. 4 the fitting body shown in FIG. 3, in a perspective view,

FIG. 5 the fitting body shown in FIG. 3, in a lateral sectional illustration, FIG. 6 in an exploded illustration, a hinge body with a hinge cup for fastening the furniture hinge to a furniture door, shutter or the like;

FIG. 7 the assembled hinge body shown in FIG. 6, in a plan view,

FIG. 8 the hinge body shown in FIG. 7, in a perspective view,

FIG. 9 the hinge body shown in FIG. 7, in a lateral sectional illustration, FIG. 10 in a perspective view, the hinge body and the fitting body in a mutually aligned position, FIG. 11 in a perspective view, the assembled furniture hinge, FIG. 12 the furniture hinge shown in FIG. 11, in a plan view, FIG. 13 the furniture hinge shown in FIG. 11, in a lateral sectional illustration, and FIG. 14 in a side view, the furniture hinge fitted to a furniture piece.

FIG. 1 shows, in a perspective view, a furniture piece 2 having a furniture door 5 coupled in a jointed manner. It is conceivable, instead of the furniture door 5, to also provide a shutter or other furniture part which is hinge-connected to the furniture piece 2. The furniture door 5 or the shutter or other furniture part may also be referred to as a pivoted furniture part 5. The furniture door 5 is fastened to a frame 4 of a furniture carcass 3 by two furniture hinges 1. A fitting body 6 and a hinge body 7 are associated with each furniture hinge 1. The hinge body 7 is connected to the furniture door 5. The fitting body 6 is fixed to the frame 4. In this case, the fitting body 6 is fastened to the end face of the frame 4. Such a manner of fitting is also known as face frame and is used in particular in the US American market. The furniture hinges 1 enable the furniture door 5 to open and close in a pivotal movement. The fitting body 6 may also be referred to as a fitting assembly 6 and the hinge body 7 may also be referred to as a hinge assembly 7.

A coordinate system 8 shows, with reference to the alignment of the furniture piece 3, three spatial directions, namely an X direction 8.1, a Y direction 8.2 and a Z direction 8.3. The spatial directions indicate possible adjustment directions of the furniture door 5, as enabled by the furniture hinge 1.

FIG. 2 shows, in an exploded illustration, the fitting body 6 for fastening the furniture hinge 1 to the furniture carcass 3. A base support 10 and a blocking element 20 are associated with the furniture carcass 6.

The base support 10 serves for fastening the fitting body 6 to the furniture piece 2 shown in FIG. 1. To this end, it is preferably formed as a punched part, in particular as a punched sheet-metal part. A fitting portion 11 of the fitting body 6 is formed in a plate shape. It has a recess 12. On the side facing away from the viewer, the base support 10 forms a fitting surface 10.1 in the region of the fitting portion 11. The fitting surface 10.1 is delimited by two inner stops 13 and by two outer stops 14, which are opposite one another in a fitting direction 9.1 illustrated by an arrow. The stops 13, 14 are formed as angled lugs integrally formed on the fitting portion 11. They are aligned in such a way that they project beyond the fitting surface 10.1.

Two lateral guides 15 are integrally formed in each case laterally and opposite to one another on the fitting portion 11 of the base support 10. In this case, the lateral guides 15 are arranged along the edges of the fitting portion 11 which are arranged transversely to the fitting direction 9.1. They are aligned angled with respect to the fitting portion 11 and facing away from the fitting surface 10.1. At the ends, the lateral guides 15 are angled in such a way that the terminating edges of the oppositely arranged lateral guides 15 are facing one another. The lateral guides 15 therefore each form a lateral portion 15.1 and a cover portion 15.2 integrally formed thereon, which, together with the fitting portion 11, each encompass a guide groove 15.4. The guide grooves 15.4 of opposing lateral guides 15 are facing one another. They form a sliding guide 15.3. The sliding guide 15.3 is aligned in the fitting direction 9.1.

A holding projection 16 is fastened to the fitting portion 11 via a step 16.1. The holding projection 16 is integrally formed on the fitting portion 11 outside the region delimited by the stops 13, 14. Two holding webs 17 are integrally formed laterally on the holding projection 16. The holding webs 17 are formed as lugs which are angled in relation to the holding projection 16. The holding webs 17 are preferably arranged at an angle of 90° in relation to the holding projection 16. In this case, they are angled in the direction facing away from the fitting surface 10.1. The surface normals of the holding webs 17 are aligned transversely to the fitting direction 9.1. Each of the holding webs 17 is penetrated by an axial bore 17.1. The axial bores 17.1 of the oppositely arranged holding webs 17 are aligned flush with one another. Nub-shaped spring guides 18 are integrally formed between the holding webs 17 on the edge of the holding projection 16.

The blocking element 20 is formed in a bracket shape. It has a planar actuating element 21 on which laterally angled joint portions 22 are integrally formed 22. An axial socket 22.1 in the form of a bore is incorporated in the joint portions 22 in each case. The axial sockets 22.1 are aligned flush with one another. The joint portions 22 are aligned in such a way that, when the fitting body 6 is fitted, they are arranged laterally to, and at a slight spacing from, the holding webs 17 of the base support 10. The axial sockets 22.1 are then aligned flush with the axial bores 17.1 of the holding webs 17. Covered or partially covered by the actuating portion 21, stops 24 and a holding portion 23, as shown in FIG. 5, are integrally formed on the actuating portion 21. In this case, the stops 24 and the holding portion 23 are arranged on the edge of the actuating portion 21 which is aligned contrary to the fitting direction 9.1. They are formed in a lug shape and angled in relation to the actuating portion 21 in the direction of the holding projection 16. The actuating portion 21 forms an actuating side 21.1 on its side facing away from the holding projection 16 and a spring contact surface 21.2. opposite this. The actuating side 21.1 has a structured surface to improve the look and feel.

A pivot 26 is furthermore associated with the fitting body 6. The pivot 26 has end stops in the form of widened portions 26.1. In this case, at least one of the widened portions 26.1 is only attached during the assembly of the fitting body 6.

Two springs 25 are associated with the blocking element 20. The springs 25 each have a coil region 25.1 which is connected to a spring clip 25.3. The ends of the springs 25 are formed as legs 25.2. The legs 25.2 of the springs 25 are aligned in the direction of the spring contact surface 21.1 of the blocking element 20 and the spring clips 25.3 are aligned in the direction of the surface of the holding projection 16.

FIG. 3 shows the assembled fitting body 6 shown in FIG. 2, in a plan view. In this case, the same components have the reference signs introduced for FIG. 2. The blocking element 20 is pivotably connected to the base support 10 of the fitting body 6 by means of the pivot 26. To this end, as clearly revealed in FIG. 4, the joint portions 22 are arranged laterally outside the holding webs 17 and the pivot 26 is pushed through the now flush axial sockets 22.1 and axial bores 17.1 as shown in FIG. 2. The widened portions 26.1 are integrally formed on the ends of the pivot 26 so that this cannot be inadvertently pushed out of the axial bores 17.1 and axial sockets 22.1. The pivot 26 therefore forms a pivot axis for the blocking element 20. This is arranged as an extension of the sliding guide 15.3 in the fitting direction 9.1. The springs 25 are inserted, pre-tensioned, between the spring contact surface 21.2, shown in FIG. 2, of the actuating portion 21 and the opposite side of the holding projection 16 of the base support 10. They therefore press the blocking element 20 into its closed position. In this closed position, the blocking element 20 abuts with its stops 24, shown in FIG. 2, against the holding projection 16.

With reference to the description of FIG. 3, FIG. 4 shows the fitting body 6 shown in FIG. 3 in a perspective view. In this perspective, the arrangement of the springs 25 can be clearly seen. The spring clips 25.3 abut against the side of the holding projection 16 which faces the blocking element 20. They are laterally guided through the spring guides 18 integrally formed on the holding projection 16. The legs 25.2 of the springs 25 abut against the spring contact surface 21.2 of the actuating portion 21 of the blocking element 20. The blocking element 20 is adjusted into its closed position as a result of the pre-tension of the springs 25.

FIG. 5 shows the fitting body 6 shown in FIG. 3 in a lateral sectional illustration. In this case, the section follows the section line denoted by V in FIG. 3. The base support 10 has, in its fitting portion 11, the fitting surface 10.1 with which the fitting body 6 abuts against the furniture carcass 3 when the furniture hinge 1 is fitted. The inner and outer stops 13, 14 are integrally formed on the fitting portion 11 and protrude over the fitting surface 10.1. The fitting surface 10.1 is therefore delimited by the stops 13, 14. The fitting body 6 can therefore be placed with the fitting surface 10.1 on the frame 4 of a furniture carcass 3 and aligned in relation to this with the aid of at least two of the stops 13, 14. The lateral guides 15 are integrally formed laterally on the base support 10. In this case, the guide grooves 15.4 are aligned in the direction of the fitting portion 11. Together with the opposing lateral guides 15 and the fitting portion 11, the guide grooves 15.4 form a sliding guide 15.3. This is aligned in the fitting direction 9.1. The fitting portion 11 merges into the holding portion 16 via the step 16.1. This holding portion is aligned parallel offset from the fitting portion 11. The blocking element 20 is pivotably connected to the holding webs 17 of the base support 10 by means of the pivot 26. To this end, the pivot 26, as described with reference to FIG. 3, is pushed through the axial bores 17.1 of the oppositely arranged holding webs 17 and the axial sockets 22.1, which are integrally formed in the joint portions 22 of the blocking element 20. The springs 25 are each pushed with their coil region 25.1 onto the pivot 26. In this case, the legs 25.2 of the springs 25 abut against the spring contact surface 21.2 of the blocking element 20. The spring clips 25.3 abut against the holding projection 16. They are laterally guided through the spring guides 18 integrally formed on the holding projection 16. The springs 25 are pre-tensioned. A torque directed contrary to an actuating direction 9.2. denoted by an arrow is thus transmitted to the blocking element 20. The blocking element 20 is thus adjusted about its pivot axis, formed by the pivot 26, into the closed position shown and held in this position. In this closed position, the stops 24 abut against the holding projection 16. As a result of the step 16.1, it is achieved that the pivot axis formed by the pivot 26 is arranged as an extension of the sliding guide 15.3. The stops 24 are formed in such a way that a run-in chamfer 23.1, which is attached at the end of the holding portion 23 of the blocking element 20, is arranged at the height of the sliding guide 15.3 and aligned towards this. As a result of a pressure on the actuating side 21.1, the blocking element 20 can be adjusted from its closed position shown into an open position according to the actuating direction 9.2 contrary to the spring force.

FIG. 6 shows, in an exploded illustration, a hinge body 7 with a hinge cup 30 for fastening the furniture hinge 1 to a furniture door 5, shutter or the like. A hinge arm 40 and, in the present case, an intermediate part 80 and a connecting element 50 are associated with the hinge body 7.

As shown in FIG. 1, the hinge cup 30 can be embedded in a bore in the furniture door 5 and screwed to the furniture door 5, shutter or the like by screws which are guided through lateral flanges 33 integrally formed laterally on the hinge cup 30. To this end, the lateral flanges 33 are penetrated by fitting bores 33.1. Starting from an outer contact surface 32, a centering region 31 forms a depression which merges into a fitting region 34 (see FIG. 9) of the hinge cup 30, which fitting region is likewise designed as a depression. Towards the furniture door 5, the hinge cup 30 is terminated in the fitting region 34 by a cover 37. Latching recesses in the form of openings are incorporated in the cover 37. Latching elements 73 are latched in the latching recesses. The latching elements 73 are part of a housing 70, shown in FIG. 9, for receiving a damper 60. The damper 60 is therefore arranged outside the hinge cup 30 below the cover 37 of the fitting region 34. To create sufficient space for receiving the damper 60, the cover 37 has a molded portion 37.1 along which the damper 60 is arranged.

A portion of the damper 60 is introduced into the centering region 31 through an opening 35. In the exemplary embodiment shown, a movably mounted cylinder 61 of a linear damper is introduced into the centering region 31. The cylinder 61 has a chamfered portion 62 at the end. A locking element 36 is rotatably mounted in the cover 37. The damper 60 can be blocked in a retracted position with the aid of the locking element 36 so that the chamfered portion 62 is not guided into the centering region 31.

A second spring 38 is likewise arranged outside the hinge cup 30. It is guided by its free ends 38.2 into the centering region 31 through the opening 35. The second spring 38, designed as a leg spring, has a coil 38.3 and a second spring clip 38.1.

The centering region 31 is formed by lateral cup walls 31.2, a rounded portion 31.4 and a cup base 31.1. Joint sockets 31.3 in the form of bores are embedded in the opposing lateral cup walls 31.2. A joint pin 39 with stop portions 39.1 at the ends is associated with the joint sockets 31.3. In this case, a stop portion 39.1 is only integrally formed on the joint pin 39 when the hinge body 7 is assembled.

The hinge arm 40 has a joint lever 43. At the end, and facing the hinge cup 30, a pin socket 41 is integrally formed on the joint lever 43, as shown in more detail in FIG. 9. The pin socket 41 is formed as a cylindrically curved end region of the joint lever 43. Two guide curves 42 are arranged laterally opposed on the joint lever 43 in the region of the pin socket 41.

The joint lever 43 is connected in one piece to a fastening portion 44 of the hinge arm 40. It is also conceivable to form the joint lever 43 and the fastening portion 44 separately and to connect them to one another, for example with the aid of fastening means. The fastening portion 44 is preferably designed as a punched part. It has lateral regions 44.2 angled laterally towards the connecting element 50. These form guide surfaces 41.1 aligned in the direction of the longitudinal extent of the hinge arm 40. A thread socket 45 and a recess 46 are incorporated in the fastening portion 44. A projection piece 44.3 is integrally formed on the fastening portion 44 via a step. In this case, the plane of the projection piece 44.3 is arranged offset in the direction of the intermediate part 80 in relation to the plane of the fastening portion 44. The projection piece 44.3 is interrupted by an X eccentric guide 47 in the form of an elongated hole.

The intermediate part 80 is arranged between the hinge arm 40 and the connecting element 50 and aligned for fitting with the hinge arm 40 and the connecting element 50. The intermediate part 80 has a contact portion 81 in a planar design, on which a projection 82, likewise in a planar design, is integrally formed. In this case, the plane of the projection 82 is offset in the direction of the hinge arm 40 in relation to the plane of the contact portion 81. The projection 82 is arranged opposite the projection piece 44.3 of the hinge arm 40. The projection 82 in the present case is connected to the contact portion 81 by three webs 81.2 aligned towards the hinge arm 40. Between the webs 81.2, the contact portion 81 has, in each case, an extension in the form of guide lugs 81.1.

An X eccentric bearing 83 in the form of a bore is incorporated, flush with the X eccentric guide 47, in the projection 82. Opposite the recess 46 of the hinge arm 40, a Y eccentric guide 84 in the form of an elongated hole and a through-opening 86 are integrally formed in the contact portion 81. Opposite the Y eccentric guide 84, a Y guide curve 89 is attached to the contact portion 81. The Y guide curve 89 is guided through the contact portion 81 and rises above the surface of the contact portion 81 in the direction of the connecting element 50. Lateral lugs are attached laterally to the contact portion 81. The lateral lugs 85 are angled in relation to the contact portion 81 and aligned in the direction of the hinge arm 40. Opposite the projection 82, a fastening web 87 is integrally formed on the contact portion 81. The fastening web 87 rises above the surface of the contact portion 81 in the direction of the hinge arm 40. Its upper surface is arranged at the height of the projection 82 of the intermediate part 80. Starting from the outer edge of the fastening web 87, an adjusting-screw socket 88 in the form of a slot is incorporated in the surface of said fastening web 87. The adjusting-screw socket 88 is arranged opposite the thread socket 45 of the hinge arm 40.

The connecting element 50 has a base body 51 in a planar design. In the fitting direction 9.1, an extension of the base body 51 forms a holding region 51.1. In the region of the front end of the holding region 51.1, relative to the fitting direction 9.1, this holding region is penetrated by a latching recess 51.2. The front edge of the holding region 51.1 has a chamfered portion 51.3. This is aligned in the fitting direction 9.1 and towards the hinge arm 40. Two outer holding lugs 55 are integrally formed on the base body 51, laterally to the holding region 51.1 and set back from the front edge thereof. The outer holding lugs 55 are bent out of the plane of the base body 51 in the direction of the hinge arm 40 in such a way that they each reach around an outer holding groove 55.1 which is open contrary to the fitting direction 9.1. Opposite the outer holding lugs 55, inner holding lugs 54 are integrally formed on the edge of the base body 51. The inner holding lugs 54 are formed to be mirror-symmetrical to the outer holding lugs 55 so that an inner holding groove 54.1, encompassed by the inner holding lugs 54, is aligned in the direction of the opposing outer holding groove 55.1 of the outer holding lugs 55 in each case. A linear guide aligned transversely to the fitting direction 9.1 is therefore formed by the holding lugs 54, 55. The intermediate part 80 can be introduced into the inner holding grooves 54.1 by its edge which is aligned contrary to the fitting direction 9.1, and into the outer holding groove 55.1 by its edges of the guide lugs 81.1 which are aligned in the fitting direction 9.1. The intermediate part 80 can therefore be displaced transversely to the fitting direction 9.1 and in the plane of the contact portion 81 whilst it is held in the remaining directions by the holding lugs 54, 55 and the base body 51 of the connecting element 50. In this case, the Y guide cam 89 is guided in a Y elongated guide hole 58 of the connecting element 50.

A respective guide portion 52 is integrally formed, laterally opposite one another, on the base body 51 of the connecting element 50. The guide portions 52 have a planar design. They are aligned in the fitting direction 9.1. along their longitudinal extent. The front ends of the guide portions 52, relative to the fitting direction 9.1, are arranged set back in relation to the front end of the holding region 51.1, as revealed more precisely in FIG. 7. The lateral edges of the guide portions 52, which are arranged transversely to the fitting direction 9.1, form guide edges 52.3. The guide portions 52 taper towards the front end. An outwardly facing infeed chamfer 52.1 is thus formed in each case on the guide portions 52 as an extension of the guide edges 52.3. A respective stop portion 52.2 is integrally formed on the guide portions 52, contrary to the movement direction 9.1 and opposite the infeed chamfers 52.1. These stop portions delimit the guide edges 52.3.

An opening 53 is incorporated in the base body 51. The opening 53 is arranged opposite the through-opening 86 of the intermediate part 80 and therefore the recess 46 of the hinge arm 40. A Y eccentric bearing 56 in the form of a bore is incorporated in the base body 51 to the side of the opening 53 of the base body 51. The Y eccentric bearing 56 is arranged flush with the Y eccentric guide 84 of the intermediate part 80. The base body 51 is penetrated by the Y guide hole 58 on the opposite side of the opening 53. The Y elongated guide hole 58 is arranged opposite the Y guide cam 89 of the intermediate part 80.

An adjusting screw 90 with an adjusting-screw tool socket 90.1, a thread 90.2, a groove 90.3 and an end portion 90.4 is furthermore associated with the hinge body 7. The adjusting screw 90 is formed in such a way that it can be screwed by its thread 90.2 into the thread socket 45 of the hinge arm 40. The groove 90.3 then engages in the adjusting-screw socket 88 of the intermediate part 80. The fitted adjusting screw 90 is held axially on the fastening web 87 of the intermediate part 80 by the end portion 90.4 which has diameter which is larger than the groove.

An X eccentric 91 is associated with the hinge body 7. The X eccentric 91 has an X tool socket 91.1, an X guide region 91.2, and an X eccentric cam 91.3. The X eccentric cam 91.3 is arranged outside the center axis of the X guide region 91.2. The X eccentric 91 is aligned with respect to the X eccentric guide 47 of the hinge 40 and the X eccentric bearing 83 of the intermediate part 80. Fitted, the X eccentric cam 91.3 engages in the X eccentric bearing 83. The X guide region 91.2 is guided in the X eccentric guide 47 of the hinge arm 40.

A Y eccentric 92, which corresponds in terms of its construction to the X eccentric 91, is furthermore associated with the hinge body 7. It therefore has a Y tool socket 92.1, a Y guide region 92.2 and a Y eccentric cam 92.3. The Y eccentric cam 92.3 is arranged outside the center axis of the Y guide region 92.2. The Y eccentric 92 is aligned with respect to the Y eccentric guide 84 of the intermediate part 80 and the Y eccentric bearing 56 of the connecting element 50. Fitted, the Y eccentric cam 92.3 engages in the Y eccentric bearing 56. The Y guide region 92.2 is guided in the Y eccentric guide 84 of the intermediate part 80.

FIG. 7 shows the assembled hinge body 7, shown in FIG. 6, in a plan view. In FIG. 8, the hinge body 7 shown in FIG. 7 is illustrated in a perspective view, whilst FIG. 9 shows the hinge body 7 shown in FIG. 7 in a lateral sectional illustration. In this case the section extends along a section line denoted by IX in FIG. 7.

As revealed in particular in FIG. 9, the joint lever 43 is guided into the centering region 31 of the hinge cup 30 and fixed there in a jointed manner. To this end, the joint pin 39 shown in FIG. 6 is guided through the joint sockets 31.3 of the lateral cup walls 31.2 of the centering region 31 and the pin socket 41 of the joint lever 43 and fixed axially by stop portions 39.1 at the ends, as revealed in particular in FIG. 8. The free ends 38.2 of the second spring 38 lie on the guide curves 42 on the joint lever 43 and transmit a spring force thereto. In this case, the guide curves 42 are configured such that the second spring 38, from a certain opening angle of the furniture hinge 1, promotes an opening movement, and, from a certain closing angle of the furniture hinge 1, a closing movement, of the furniture hinge 1 and therefore the connected furniture door 5, shutter or the like. As clearly shown in FIG. 9, the damper 60 is introduced with the chamfered portion 62 of its cylinder 61 into the centering region 31 and therefore into the adjustment path of the joint lever 43. The damper 60 is supported opposite this on the housing 70 by a piston 63. During the closing of the furniture hinge 1, the joint lever 43 abuts against the chamfered portion 62 of the damper 60 and compresses this. The closing movement of the furniture hinge 1 is thus damped in its final movement portion. The movement of the damper 60 can be blocked in its inserted position by the blocking element 36 shown in FIGS. 7 and 8. A furniture hinge 1 which is not damped is thus obtained.

The fastening portion 44 of the hinge arm 40 is connected to the intermediate part 80, as shown in more detail in FIG. 9. The intermediate part 80 is in turn connected to the connecting element 50. In this case, the intermediate part 80 is mounted on the connecting element 50 to be linearly adjustable transversely to the fitting direction 9.1, as is described with reference to FIG. 6.

As clearly revealed in FIG. 9, the adjusting screw 90 is screwed by its thread 90.2 into the thread socket 45 of the hinge arm 40. It is mounted by its groove 90.3 in the adjusting-screw socket 88. By means of the end portion 90.4 which has a diameter which is wider than the groove 90.3, the intermediate part 80 is held axially by the adjusting screw 90. The X eccentric 91 is laterally guided by its X guide region 91.2 in the X eccentric guide 47 of the hinge arm 40 and inserted with its eccentrically arranged X eccentric cam 91.3 into the X eccentric bearing 83 of the intermediate part 80. The Y eccentric 92 is laterally guided accordingly (not illustrated in section) by its Y guide region 92.2. in the Y eccentric guide 84 of the intermediate part 80 and inserted with its Y eccentric cam 92.3 into the Y eccentric bearing 56 (shown in FIG. 6) of the connecting element 50. In this case, the Y tool socket 92.1 is accessible via the recess 46 in the fastening portion 44 of the hinge arm 40, as revealed in particular in FIG. 7.

The adjusting screw 90 and the two eccentrics 91, 92 serve for aligning the fitted furniture door 5 on the furniture carcass 3. In this case, the spacing between the fastening portion 44 of the hinge arm 40 and the intermediate part 80 can be altered by means of the adjusting screw 90 and the furniture door 5 can therefore be adjusted along the Z-axis 8.3, as shown in FIG. 1. The X eccentric 91 enables the adjustment of the fitted furniture door 5 along the X-axis 8.1 shown in FIG. 1. In this case, the hinge arm 40 is displaced in relation to the intermediate part 80 in the X direction 8.1 via a rotation of the X eccentric 91. To this end, the intermediate part 80 is laterally guided by the guide surfaces 44.1 of the lateral regions 44.2 of the fastening portion 44 of the hinge arm 40, against which the lateral lugs 85 and the projection 82 of the intermediate part 80 abut (see FIG. 6 in this regard). The Y eccentric 92 enables the alignment of the furniture door 5 along the y-axis 8.2 shown in FIG. 1. The intermediate part 80 and therefore the hinge arm 40 connected to the intermediate part 80 such that it is blocked in the Y direction, is adjusted linearly along the Y-axis 8.2 in relation to the connecting element 50 via a rotation of the Y eccentric 92. In this case, the intermediate part moves in a guided manner through the holding grooves 54.1, 55.1 formed by the holding lugs 54, 55, as are likewise shown in FIG. 6. In this case, additional guidance is achieved by the Y guide cam 89 of the intermediate part 80, which is linearly guided in the Y elongated guide hole 58 of the connecting element 50.

As revealed in FIGS. 7 and 9, in the fitting direction 9.1, the holding region 51.1 of the base body 51 of the connecting element 50 forms the front-most region of the hinge body 7 with its chamfered portion 51.3.

As can be seen in particular in the view selected in FIG. 8, the second spring 38 is arranged outside the hinge cup 30. As shown in FIG. 7, it is guided by its free end 38.2 through the opening 35 in the centering region 31 of the hinge cup 30 and there to the guide curves 42 of the hinge arm 40. The damper 60 is likewise arranged with its housing 70 below the fitting region 34 of the hinge cup 30 and guided through the opening 35 into the centering region 31. In the sectional illustration in FIG. 9, the bearing of the second spring 38 on the housing 70 is shown. Towards its housing base 71, the housing 70 forms the side of a spring socket 72 which faces away from the hinge arm 40. The second spring clip 38.1 of the second spring 38 is held in the spring socket 72.

As shown in particular in FIG. 9, the centering region 31, starting from the outer contact surface 32, has a depression. The fitting region 34 likewise forms such a depression. In this case, the cup depth in the fitting region 34 is smaller than in the centering region 41. The fitting region 34 is terminated by a cover 37. The damper 60 is attached externally to the cover 37 of the fitting region 34. To this end, the damper 60 is mounted in the housing 70. The housing 70 is fastened to the cover 37 of the fitting region 34 by means of the latching elements 73 shown in FIG. 6. The housing base 71 is preferably arranged in the same plane as the cup base 31.1 of the centering region 31.

FIG. 10 shows, in a perspective view, the hinge body 7 and the fitting body 6 in a mutually aligned position. The hinge body 7 is opened and held in this position by the second spring 38. The holding region 51.1 of the connecting element 50 is aligned in the direction of the blocking element 20 of the fitting body 6. The guide portions 52 of the connecting element 50 protrude laterally over the fastening portion 44 of the hinge arm 40. The hinge body 7 can therefore be inserted with its guide portions 52 along the fitting direction 9.1 into the sliding guide 15.3 of the fitting body 6. In this case, the sliding guide 15.3 is formed by the guide grooves 15.4, as formed by the lateral guides 15 arranged laterally on the fitting portion 11 of the base support 10 of the fitting body 6. During the insertion of the connecting element 50 into the sliding guide 15.3, the guide edges 52.3 of the guide portions 52 slide along the inner surfaces of the lateral portions 15.1 of the lateral guides 15. Therefore, when the guide portions 52 are inserted into the slide guide 15.3, the hinge body 7 can only be adjusted in or contrary to the fitting direction 9.1. The infeed chamfers 52.1 facilitate the introduction of the guide portions 52 into the guide grooves 15.4.

In a first fitting step, the connecting element 50 is inserted into the sliding guide 15.3 until the chamfered portion 51.3 of the holding region 51.1 strikes the run-in chamfer 23.1 (shown in FIG. 5) of the blocking element 20. The hinge body 7 is now held transversely to the fitting direction 9.1 on the fitting body 6. During the further insertion of the connecting element 50 into the sliding guide 15.3, the blocking element 20 is adjusted along the actuating direction 9.2 from its closed position shown in FIG. 10 into an open position as a result of the chamfered portion 51.3 sliding past the run-in chamfer 23.1. In this case, the blocking element 20 pivots about the pivot axis formed by the pivot 26 contrary to the spring force introduced by the two springs 25. During the further displacement of the connecting element 50 in the fitting direction 9.1, the latching recess 51.2 arrives in the region of the holding portion 23 shown in FIG. 5. The blocking element 20 is now adjusted back into its closed position by the springs 25. The hinge body 7 is thus also blocked in or contrary to the fitting direction 9.1. Upon reaching the fitting position, in which the latching recess 51.2 is arranged opposite the holding portion 23 of the blocking element 20, the stop portions 52.2 laterally attached to the guide portions 52 abut against the front lateral guides 15.1 of the sliding guide 15.3. Precise alignment of the hinge body 7 in relation to the fitting body 6 is thus achieved in the fitting position.

FIG. 11 shows the assembled furniture hinge 1 in a perspective view. In FIG. 12, the furniture hinge 1 shown in FIG. 11 is illustrated in a plan view. FIG. 13 shows the furniture hinge 1 shown in FIG. 11 in a lateral sectional illustration. In this case, the section line is indicated in FIG. 12 and denoted by XIII.

As a component connected to the hinge arm 40, the connecting element 50 is inserted into the sliding guide 15.3 of the fitting body 6 until it has reached its fitting position. The connecting element 50 is held transversely to the fitting direction 9.1 by the lateral guides 15. In the fitting direction 9.1, the stop portions 52.2 abut against the lateral guides 15 facing away from the blocking element 20. The connecting element 50 is blocked contrary to the fitting direction 9.1 by the engagement of the holding portion 23 of the blocking element 20 in the latching recess 51.2 of the holding region 51.1 of the connecting element 50, as revealed in particular in the sectional illustration in FIG. 13. The blocking element 20 is held in its closed position by the two springs 25. The hinge body 7 is therefore fixed to the fitting body 6. Thus, the blocking element 20 may also be referred to as a latch 20 which is configured to engage the latching recess 51.2 of the holding region 51.1 to block movement of the guide portion 52 opposite to the fitting direction 9.1.

To release the hinge body 7 from the fitting body 6, the blocking element 20 can be adjusted into its open position contrary to the spring force introduced by the springs 25 by a pressure on the actuating side 21.1 of its actuating portion 21. In this case, the blocking element 20 is pivoted about the pivot 26 according to the actuating direction 9.2. The holding portion 23 of the blocking element 20 is therefore brought out of engagement with the latching recess 51.2 of the holding region 51.1 of the connecting element 50. The connecting element 50 can now be drawn out of the sliding guide 15.3 contrary to the fitting direction 9.1.

FIG. 14 in a side view the furniture hinge 1 fitted to a furniture piece 2. The hinge cup 40 is fixed in a bore of the furniture door 5 shown in FIG. 1 and screwed laterally to the furniture door 5 on lateral flanges 33. The fitting body 6 is fastened to the frame 4 of the furniture piece 2. To this end, the fitting body 6 abuts with its fitting surface 10.1 against the frame 4. The outer stop 14 abuts against the edge of the frame 4. The position of the fitting body 6 is thus fixed in relation to the frame 4. The fitting body 6 is fastened to the frame 4 by a screw connection 19 indicated by a dashed line. To this end, a screw (not shown) is guided through the recess 12 of the base support 10.

For fitting the furniture door 5, the fitting body 6 and the hinge body 7 are present separately. Both are pre-fitted. The fitting body 6 is firstly aligned with the outer stop 14 on the frame 4. The fitting body 6 is then screwed to the frame 4. The hinge cup 30 is introduced into the bore in the furniture door 5, aligned and screwed to the furniture door 5. When a plurality of furniture hinges 1 are provided, these are fitted accordingly. The furniture hinge(s) 1 are pivoted into their open position. The furniture door 5 is then held in the opening of the furniture carcass 2 and aligned such that the guide portions 52 of the respective connecting elements 50 are aligned with respect to the sliding guide 15.2 arranged on the furniture carcass 6. The furniture door 5 is now pushed in the direction of the furniture carcass 2. In this case, the guide portions 52 are fed into the sliding guide 15.3. When a plurality of furniture hinges 1 are provided on the furniture door 5, the guide portions 52 can also be fed easily and simultaneously into the sliding guides 15.2 as a result of the infeed chamfers 52.1.

The guide portions 52 are firstly inserted into the sliding guide 15.3 until the holding region 51.1 of the connecting element 50 strikes the holding portion 23 of the blocking element 20. The connecting element 50 is now held transversely to the fitting direction 9.1 in the sliding guide 15.3. The sliding guide 15.3 is aligned such that the connecting element 50 does not slide out of the sliding guide 15.3 as a result of the gravitational force. A fitter can therefore let go of the furniture door 5 when the connecting element 50 is partially inserted without it falling off. In a further operating step, the connecting element 50 is inserted further into the sliding guide 15.3 in the fitting direction 9.1. This can take place, for example, as a result of a corresponding pressure on the furniture door 5. The chamfered portion 51.3 at the front end of the holding region 51.1 thus slides past the run-in chamfer 23.1 of the blocking element 20, whereby the blocking element 20 is adjusted into its open position. The connecting element 50 can now be inserted into the sliding guide 15.3 until the final fitting position is achieved. In this fitting position, the stop portions 52.2 of the guide portions 52 abut against the front lateral guides 15 of the base support 10. The latching recess 51.2 in the holding region 51.1 of the connecting element 50 is arranged in the region of the holding portion 23 of the blocking element 20. The blocking element 20 is therefore rotated by the springs 25 into its closing position shown in FIG. 14 and the holding portion 23 is brought into engagement with the latching recess 51.2 of the connecting element 50. A movement of the hinge body 7 in or contrary to the fitting direction 9.1. is thus blocked. For dismantling purposes, the blocking element 20 is adjusted manually into its open position. The connecting element 50 can now be drawn out of its fitting position contrary to the fitting direction 9.1. In this case, the connecting element 50 is furthermore held transversely to the fitting direction 9.1 by the sliding guide 15.3. A fitter can therefore release a plurality of furniture hinges 1 provided on the furniture door 5 in succession without simultaneously having to hold the weight of the furniture door 5. If all connecting elements 50 of the provided furniture hinges 1 are drawn out of their fitting position, the furniture door 5 can be removed from the furniture carcass 3.

The invention claimed is:

1. A furniture hinge for connecting a pivoted furniture member to a furniture carcass, the furniture hinge comprising:

a fitting assembly configured to be fastened to the furniture carcass, the fitting assembly including a sliding guide;

a hinge assembly configured to be fastened to the pivoted furniture member;

a hinge arm pivotably attached to the hinge assembly, wherein the hinge arm or a component connected to the hinge arm includes at least one guide portion configured to be received in the sliding guide and displaceable along a fitting direction to a fitting position, the guide portion being held transversely to the fitting direction by the sliding guide;

a latch configured to block movement of the guide portion relative to the sliding guide opposite to the fitting direction, the latch being configured to be closed without using a tool; and wherein the latch is configured to be opened to release the hinge arm relative the fitting assembly by a human operator without using a tool;

wherein the latch is pivotably connected to the fitting assembly such that the latch is pivotable about a pivot axis relative to the fitting assembly.

2. The furniture hinge of claim 1, wherein:

the latch is movably mounted and fixes the hinge arm relative to the fitting assembly in a closed position and releases the hinge arm relative to the fitting assembly in an open position.

3. The furniture hinge of claim 2, wherein:

the latch includes a spring biasing the latch toward the closed position.

4. The furniture hinge of claim 1, wherein:

the latch is arranged on the hinge arm or on the component connected to the hinge arm or on the fitting assembly.

5. The furniture hinge of claim 1, wherein:

the latch is configured to be moved from a closed position to an open position by engagement of the hinge arm or the component connected to the hinge arm with the latch during an insertion movement of the guide portion along the fitting direction; and the latch is configured to be moved to the closed position by at least one spring when the guide portion is in the fitting position.

6. The furniture hinge of claim 1, wherein:

the fitting assembly includes a base support including a fitting portion including opposed lateral guides spaced laterally relative to the fitting direction, the lateral guides forming the sliding guide; and the guide portion is linearly movable in the opposed lateral guides.

7. The furniture hinge of claim 1, wherein:

the hinge arm or the component connected to the hinge arm includes a holding region having a latching recess; and the latch includes a holding portion configured to engage the latching recess when the guide portion is in the fitting position.

8. The furniture hinge of claim 7, wherein:

the latch includes a run-in chamfer configured such that during insertion of the guide portion into the sliding guide of the fitting assembly the run-in chamfer engages the holding region of the hinge arm or the component connected to the hinge arm.

9. The furniture hinge of claim 8, wherein:

the holding region of the hinge arm or the component connected to the hinge arm includes a chamfered portion configured such that during insertion of the guide portion into the sliding guide of the fitting assembly the run-in chamfer engages the chamfered portion.

10. The furniture hinge of claim 8, whereas:

the holding region engages the run-in chamfer of the latch within a last 5% of an insertion movement of the guide portion into the sliding guide.

11. The furniture hinge of claim 1, wherein:

the latch includes an actuating portion with which the latch can be adjusted manually from a closed position to an open position in opposition to a spring force of a spring of the latch.

12. The furniture hinge of claim 1, wherein:

the latch includes a spring biasing the latch toward a closed position; and the latch includes at least one stop configured to block movement of the latch beyond the closed position in a direction in which the spring acts.

13. The furniture hinge of claim 1, wherein:

the hinge arm or the component connected to the hinge arm includes at least one stop portion configured to block insertion movement of the guide portion into the sliding guide when the guide portion reaches the fitting position.

14. The furniture hinge of claim 1, further comprising:

an intermediate piece connected to the hinge arm;

a connecting element connected to the intermediate piece, the connecting element being the component connected to the hinge arm including the at least one guide portion; and wherein a position of the intermediate piece is adjustable in at least one spatial direction in relation to at least one of the hinge arm or the connecting element.

15. The furniture hinge of claim 1, wherein:

the fitting assembly includes a fitting surface configured to lie against the furniture carcass, and the fitting assembly includes at least one stop protruding past the fitting surface.

16. The furniture hinge of claim 1, further comprising:

the hinge assembly including a hinge cup including a centering region and a fitting region having a reduced cup depth in relation to the centering region;

a housing fastened externally to a base of the hinge cup in the fitting region;

a damper received in the housing, the damper including a piston and a cylinder;

the hinge arm including a joint lever pivotally mounted to the hinge cup in the centering region; and the hinge cup including an opening through which the piston or the cylinder is guided into the centering region and into a pivotal region of the joint lever.

17. A method of jointed fastening of a pivoted furniture member to a furniture carcass by at least one furniture hinge, the furniture hinge being constructed in accordance with claim 1, the method comprising:

partially inserting to a partially inserted position the at least one guide portion of the hinge arm or the component connected to the hinge arm into the sliding guide of the fitting assembly along the fitting direction until the hinge arm or the component connected to the hinge arm strikes the latch, wherein in the partially inserted position the hinge arm or the component connected to the hinge arm is held transversely to the fitting direction by the sliding guide; and further inserting the portion of the hinge arm or the component connected to the hinge arm and overcoming a closing force of the latch to move the latch to an open position; and when the fitting position of the hinge arm or the component connected to the hinge arm is reached, moving the latch to a closed position with an acting spring force and blocking movement of the hinge arm or the component connected to the hinge arm in a direction opposite to the fitting direction.

18. The furniture hinge of claim 1, wherein: the latch is formed in a bracket shape including a longitudinal extension extending perpendicular to the fitting direction.

19. The furniture hinge of claim 18, wherein:

the pivot axis extends parallel to the longitudinal extension of the latch.

20. The furniture hinge of claim 1, wherein:

the latch includes a planar actuating portion and a holding portion angled in relation to the actuating portion in a direction of the guide portion when in the fitting position.

* * * * *